US011087569B2

(12) United States Patent
Righi et al.

(10) Patent No.: US 11,087,569 B2
(45) Date of Patent: Aug. 10, 2021

(54) VEHICLE ACCIDENT DATA MANAGEMENT SYSTEM

(71) Applicant: International Business Machines Corporation, Armonk, NY (US)

(72) Inventors: Wiliam Pereira Righi, Farroupilha (BR); Marco Aurelio Stelmar Netto, Sao Paulo (BR); Facundo Miguel Oliveri, Sao Paulo (BR); Juliano Rodovalho Macedo, Catalão (BR)

(73) Assignee: International Business Machines Corporation, Armonk, NY (US)

( * ) Notice: Subject to any disclaimer, the term of this patent is extended or adjusted under 35 U.S.C. 154(b) by 224 days.

(21) Appl. No.: 16/363,311

(22) Filed: Mar. 25, 2019

(65) Prior Publication Data

US 2020/0312046 A1 Oct. 1, 2020

(51) Int. Cl.
*G07C 5/00* (2006.01)
*G07C 5/08* (2006.01)

(52) U.S. Cl.
CPC ..... *G07C 5/008* (2013.01); *G07C 5/085* (2013.01)

(58) Field of Classification Search
CPC ..... G07C 5/008; G07C 5/085; G07C 5/0866; B60W 30/00; B60W 40/00; H04L 1/00;
(Continued)

(56) References Cited

U.S. PATENT DOCUMENTS 9,491,420 B2 11/2016 Mimar
9,805,423 B1 * 10/2017 Konrardy ..... G07C 5/0808
(Continued)

FOREIGN PATENT DOCUMENTS

CN 101742981 A 6/2010
CN 103295396 A 9/2013
(Continued)

OTHER PUBLICATIONS

Guo et al., "Blockchain-inspired Event Recording System for Autonomous Vehicles," IEEE HotICN, IEEE, Sep. 2018, 5 pages. https://arxiv.org/pdf/1809.04732.pdf.
(Continued)

*Primary Examiner* — Abby Y Lin
*Assistant Examiner* — Hossam M Abd El Latif
(74) *Attorney, Agent, or Firm* — Yee & Associates, P.C.

(57) ABSTRACT

A method, apparatus, system, and computer program product for processing vehicle accident information. Selected information is collected from a sensor system for a vehicle to form initial accident information in response to detecting an accident involving the vehicle. A first assessment of a severity of the accident is determined using the initial accident information. A vehicle notification of the accident is sent by the computer system onto a distributed network. A set of client devices located within a selected distance from the vehicle is searched for in response to the vehicle notification of the accident. Additional accident information is requested from the set of client devices when the set of client devices are present within the selected distance from the vehicle. A second assessment of the severity of the accident is determined using the initial accident information and the additional accident information received from the set of client devices.

17 Claims, 7 Drawing Sheets

(58) Field of Classification Search
CPC ..... H04L 2201/00; G05D 1/00; G01S 1/00; G06K 1/00; H04W 4/00
USPC ..... 701/32
See application file for complete search history.

(56) References Cited

U.S. PATENT DOCUMENTS

| | | | | |
|---|---|---|---|---|
| 10,083,551 | B1 * | 9/2018 | Schmitt | G07C 5/085 |
| 10,580,306 | B1 * | 3/2020 | Harris | G06Q 10/0631 |
| 2013/0006469 | A1 | 1/2013 | Green et al. | |
| 2013/0086109 | A1 * | 4/2013 | Huang | G06F 16/244 707/770 |
| 2016/0232785 | A1 | 8/2016 | Wang | |
| 2017/0046652 | A1 | 2/2017 | Haldenby et al. | |

FOREIGN PATENT DOCUMENTS

| | | | | |
|---|---|---|---|---|
| CN | 105355034 | A | 2/2016 | |
| CN | 108446992 | A | 8/2018 | |
| WO | WO-2018144917 | A1 * | 8/2018 | G07C 5/0841 |
| WO | WO-2020002520 | A1 * | 1/2020 | G08G 1/205 |

OTHER PUBLICATIONS

Oham et al., "A Blockchain Based Liability Attribution Framework for Autonomous Vehicles," Feb. 15, 2018, 13 pages. https://arxiv.org/pdf/1802.05050.pdf.

Johnston et al., "Ensuring Trustworthiness of Incident Evidence Data Generated by Things," Technical Disclosure Commons, Defensive Publications Series, Oct. 30, 2018, 8 pages. https://www.tdcommons.org/dpubs_series/1619.

Thompson et al., "Using Smartphones to Detect Car Accidents and Provide Situational Awareness to Emergency Responders," International Conference on Mobile Wireless Middleware, Operating Systems, and Applications Mobilware 2010: Lecture Notes of the Institute for Computer Sciences, Social Informatics and Telecommunications Engineering, vol. 48, Berlin, Heidelberg, pp. 29-42.

Gokulakrishnan et al., "Road Accident Prevention with Instant Emergency Warning Message Dissemination in Vehicular Ad-Hoc Network," PLoS One, Recearch Article, Dec. 4, 2015, 36 pages. https://journals.plos.org/plosone/article?id=10.1371/journal.pone.0143383.

Yuan et al., "Towards Blockchain-based Intelligent Transportation Systems," IEEE 19th International Conference on Intelligent Transportation Systems (ITSC), Rio de Janeiro, Brazil, Nov. 104, 2016, pp. 2663-2668.

Fanca et al., "Accident Reporting and Guidance System with automatic detection of the accident," 2016 20th International Conference on System Theory, Control and Computing (ISCTCC), Oct. 13-15, Sinaia, Romania, pp. 150-155.

Khaliq et al., "Prototype of Automatic Accident Detection and Management in Vehicular Environment Using VANET and IoT," 11th International Conference on Software, Knowledge, Information Management and Applications (SKIMA), Colombo, Sri Lanka, Dec. 6-8, 2017, 7 page.

Sharma et al., "S-CarCrash: Real-time Crash Detection Analysis and Emergency Alert using Smartphone," 2016 International Conference on Connected Vehicles and Expo (ICCVE), Seattle, Washington, Sep. 12-16, 2016, pp. 36-42.

Wang et al., "Transportation 5.0 in CPSS: Towards ACP-based Society-Centered Intelligent Transportation," 2017 IEEE 20th International Conference on Intelligent Transportation Systems (ITSC): Workshop, Yokohama, Japan, Oct. 16-19, 2017, pp. 762-767.

Singh et al., "Trust Bit: Reward-based Intelligent Vehicle Commination using Blockchain Paper," Jul. 2017, pp. 62-67 https://arxiv.org/ftp/arxiv/papers/1707/1707.07442.pdf.

* cited by examiner

VEHICLE ACCIDENT DATA MANAGEMENT SYSTEM

BACKGROUND

1. Field

The disclosure relates generally to an improved computer system and more specifically to a method, an apparatus, a system, and a computer program product for managing accident data for vehicles.

2. Description of the Related Art

Automobile accidents are commonplace worldwide. When automobiles accidents occur, many parties are often interested in obtaining more information about the accidents. The interested parties, such as health insurance companies, emergency centers, automobile repair shops, car insurance companies, and other parties should be contacted and provided the proper information to act on the accidents.

For example, an automobile repair shop may be interested in obtaining information about the damage to an automobile involved in an accident to order parts and schedule repair work. The automobile insurance company for the driver of the automobile may be interested in the information that can be analyzed to determine how the accident occurred and determine responsibility of the accident. Both the automobile repair shop and the insurance company may request or take pictures of the damage to the automobile, request police reports, and other information to take action on the accident.

Depending on the severity of the accident, other parties may need to be contacted. These other parties include, for example, a health insurance company, a hospital, and a paramedic service. These interested parties can use this information to determine what potential patients may need treatment after the accident. For example, the hospital and paramedic service located near the accident may use information about injuries to predict what capacity may be needed for their services.

Currently, information about accidents can be obtained from accident reports, police reports, and witness statements. A witness can report the occurrence of an accident to a police or paramedic service through a 911 call. This information can include, for example, a location of the accident, the number of vehicles involved, and whether injuries may have occurred. A police officer reaching the scene can collect information about the accident, take witness statements and prepare an accident report.

SUMMARY

According to one embodiment of the present invention, a method processes vehicle accident information. Selected information is collected by a computer system from a sensor system for the vehicle to form initial accident information in response to detecting an accident involving the vehicle. A first assessment of a severity of the accident is determined by the computer system using the initial accident information. A vehicle notification of the accident is sent by the computer system onto a distributed network. A set of client devices located within a selected distance from the vehicle is searched for by the computer system in response to the vehicle notification of the accident. Additional accident information is requested from the set of client devices by the computer system when the set of client devices are present within the selected distance from the vehicle. A second assessment of the severity of the accident is determined by the computer system using the initial accident information and the additional accident information received from the set of client devices.

According to another embodiment of the present invention, a vehicle accident information system comprises a computer system. The computer system collects selected information from a sensor system for the vehicle to form initial accident information in response to detecting an accident involving the vehicle. The computer system determines a first assessment of a severity of the accident using the initial accident information and sends a vehicle notification of the accident onto a distributed network. The computer system searches for a set of client devices located within a selected distance from the vehicle in response to the vehicle notification of the accident and requests additional accident information from the set of client devices when the set of client devices are present within the selected distance from the vehicle. The computer system determines a second assessment of the severity of the accident using the initial accident information and the additional accident information received from the set of client devices.

According to yet another embodiment of the present invention, a computer program product for processing vehicle accident information comprises a computer-readable-storage media with first program code, second program code, third program code, fourth program code, fifth program code, and sixth program code stored on the computer-readable storage media. The first program code is executed to collect selected information from a sensor system for the vehicle to form initial accident information in response to detecting an accident involving the vehicle. The second program code is executed to determine a first assessment of a severity of the accident using the initial accident information. The third program code is executed to send a vehicle notification of the accident onto a distributed network. The fourth program code is executed search for a set of client devices located within a selected distance from the vehicle in response to the vehicle notification of the accident. The fifth program code is executed to requests additional accident information from the set of client devices when the set of client devices are present within the selected distance from the vehicle. The sixth program code is executed to determine a second assessment of the severity of the accident using the initial accident information and the additional accident information received from the set of client devices.

DETAILED DESCRIPTION

Figure 1:
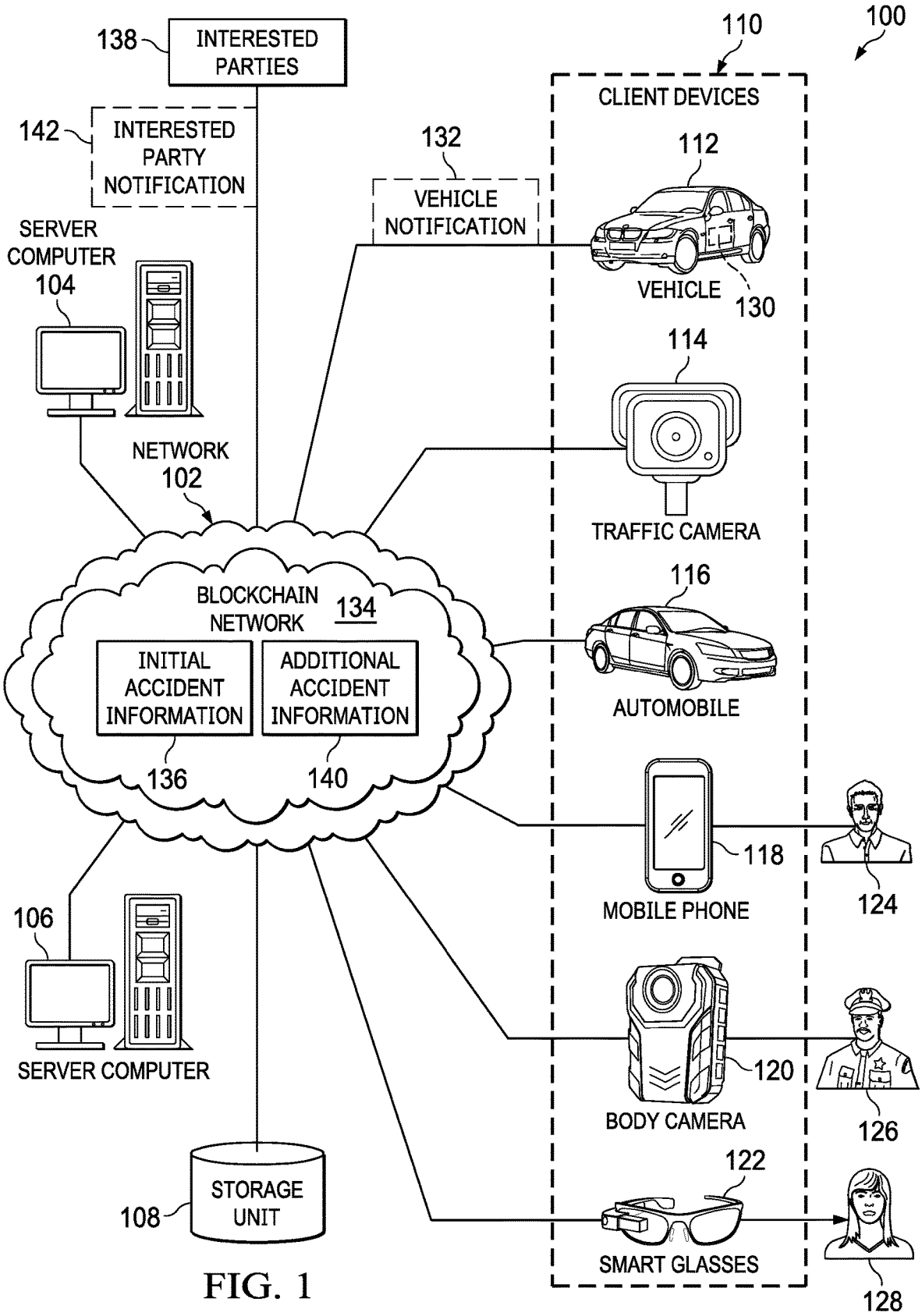
FIG. 1 is a pictorial representation of a network of data processing systems in which illustrative embodiments may be implemented.

The present invention may be a system, a method, and/or a computer program product at any possible technical detail level of integration. The computer program product may include a computer-readable storage medium (or media) having computer-readable program instructions thereon for causing a processor to carry out aspects of the present invention.

The computer-readable storage medium can be a tangible device that can retain and store instructions for use by an instruction execution device. The computer-readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer-readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer-readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer-readable program instructions described herein can be downloaded to respective computing/processing devices from a computer-readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer-readable program instructions from the network and forwards the computer-readable program instructions for storage in a computer-readable storage medium within the respective computing/processing device.

Computer-readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer-readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer-readable program instructions by utilizing state information of the computer-readable program instructions to personalize the electronic circuitry, in order to perform aspects of the present invention.

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer-readable program instructions.

These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer program instructions may also be stored in a computer-readable medium that can direct a computer, other programmable data processing apparatus, or other devices to function in a particular manner, such that the instructions stored in the computer-readable medium produce an article of manufacture including instructions which implement the function/act specified in the flowchart and/or block diagram block or blocks.

The computer-readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts or carry out combinations of special purpose hardware and computer instructions.

The illustrative embodiments recognize and take into account a number of different considerations. For example, the illustrative embodiments recognize and take into account that interested parties to an accident may have more difficulty than desired in obtaining the information needed. The illustrative embodiments recognize and take into account that an interested party such as an automobile insurance company may need information to determine fault, whether the accident is covered, and reimbursement amounts. An automobile repair shop may use information about damage to the automobile in the accident to provide estimates for repair, scheduling the repairs, and ordering parts.

The illustrative embodiments recognize and take into account that currently high reliance is made on reports generated by witnesses and officials at the scene of a vehicle accident. The illustrative embodiments recognize and take into account that other sources of information are present but may not be utilized. For example, the illustrative embodiments recognize and take into account that many cars now have computers that collect information including information about accidents. Those embodiments recognize and take into account some information can be stored in an event data recorder in the vehicle. The illustrative embodiments recognize and take into account that this information may include, for example, a speed of the vehicle, a direction of travel, a location of the vehicle, whether airbag was deployed, and other suitable information. However, event data recorders are typically proprietary to the manufacturer and may not record all of the data needed. Different events data recorders from different manufacturers may record different types of information making evaluation of accident more difficult. Further, the illustrative embodiments recognize and take into account that these event data recorders can be difficult to access.

Currently, those embodiments recognize and take into account the event data recorder in a car is accessed through a diagnostic link connector. The illustrative embodiments recognize and take into account that the access codes and interfaces for accessing this information can be different from manufacturer to manufacturer, making collecting this information more difficult than desired.

Further, the illustrative embodiments recognize and take into account that many people now have devices such as smart watches, mobile phones, and other devices that can record information before, during, and after an accident. The illustrative embodiments recognize and take into account that currently a mechanism is not available for identifying and accessing information from these devices to obtain accident information.

Additionally, the illustrative embodiments recognize and take into account that many of these devices may lack access to a high-speed network to transmit accident information. The illustrative embodiments also recognize and take account that currently a mechanism for desired data collection of accident information from various sources is absent.

Therefore, it would be desirable to have a method and apparatus that take into account at least some of the issues discussed above, as well as other possible issues. For example, it would be desirable to have a method and apparatus that overcome a technical problem with managing accident information in response to the occurrence of an accident involving a vehicle.

Thus, the illustrative embodiments provide a method, an apparatus, a system, and a computer program product for processing vehicle accident information. In one illustrative example, information is collected from a sensor system for the vehicle to form initial accident information in response to detecting an accident involving the vehicle. A first assessment of a severity of the accident is determined using the initial accident information. A vehicle notification of the accident is sent onto a distributed network system. A search is performed for a set of client devices located within a selected distance from the vehicle in response to the vehicle notification of the accident. Additional accident information is requested from the set of client devices when the set of client devices are present within the selected distance from the vehicle. A second assessment of the severity of the accident is determined using the initial accident information and the additional accident information received from the set of client devices.

With reference now to the figures and, in particular, with reference to FIG. 1, a pictorial representation of a network of data processing systems is depicted in which illustrative embodiments may be implemented. Network data processing system 100 is a network of computers in which the illustrative embodiments may be implemented. Network data processing system 100 contains network 102, which is the medium used to provide communications links between various devices and computers connected together within network data processing system 100. Network 102 may include connections, such as wire, wireless communication links, or fiber optic cables.

In the depicted example, server computer 104 and server computer 106 connect to network 102 along with storage unit 108. In addition, client devices 110 connect to network 102. As depicted, client devices 110 include vehicle 112, traffic camera 114, automobile 116, mobile phone 118, body camera 120, and smart glasses 122. As depicted, person 124 can carry and use mobile phone 118, police officer 126 can wear body camera 120, and person 128 can wear smart glasses 122. As depicted, vehicle 112 and automobile 116 are smart cars in which computers in the smart car can take the form of onboard units that can perform sophisticated data processing of information.

Client devices 110 can also include other devices such as, for example, computers, workstations, tablet computers, smart speakers, network computers, and other suitable types of devices. In the depicted example, server computer 104 provides information, such as boot files, operating system images, and applications to client devices 110.

In this illustrative example, server computer 104, server computer 106, storage unit 108, and client devices 110 are network devices that connect to network 102 in which network 102 is the communications media for these network devices. Some or all of client devices 110 may form an Internet of things (IoT) in which these physical devices can connect to network 102 and exchange information with each other over network 102.

In this illustrative example, client devices 110 can connect using wireless connections. These wireless connections include, for example, Wi-Fi connections, Bluetooth connections, infrared connections, cellular connections, or other types of wireless conditions. With wireless connections, client devices 110 can move and form a distributed network which also may be an ad hoc distributed network in some implementations.

Client devices 110 are clients to server computer 104 in this example. Network data processing system 100 may include additional server computers, client computers, and other devices not shown. Client devices 110 connect to network 102 utilizing at least one of wired, optical fiber, or wireless connections.

Program code located in network data processing system 100 can be stored on a computer-recordable storage medium and downloaded to a data processing system or other device for use. For example, program code can be stored on a computer-recordable storage medium on server computer 104 and downloaded to client devices 110 over network 102 for use on client devices 110.

In the depicted example, network data processing system 100 is the Internet with network 102 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers consisting of thousands of commercial, governmental, educational, and other computer systems that route data and messages. Of course, network data processing system 100 also may be implemented using a number of different types of networks. For example, network 102 can be comprised of at least one of the Internet, an intranet, a local area network (LAN), a metropolitan area network (MAN), or a wide area network (WAN). FIG. 1 is intended as an example, and not as an architectural limitation for the different illustrative embodiments.

As used herein, "a number of" when used with reference to items, means one or more items. For example, "a number of different types of networks" is one or more different types of networks.

Further, the phrase "at least one of," when used with a list of items, means different combinations of one or more of the listed items can be used, and only one of each item in the list may be needed. In other words, "at least one of" means any combination of items and number of items may be used from the list, but not all of the items in the list are required. The item can be a particular object, a thing, or a category.

For example, without limitation, "at least one of item A, item B, or item C" may include item A, item A and item B, or item B. This example also may include item A, item B, and item C or item B and item C. Of course, any combinations of these items can be present. In some illustrative examples, "at least one of" can be, for example, without limitation, two of item A; one of item B; and ten of item C; four of item B and seven of item C; or other suitable combinations.

As depicted, vehicle 112 is a smart car. In this illustrative example, vehicle 112 includes a computing device such as an onboard unit 130. Onboard unit 130 is in communication with sensors for vehicle 112 through wireless or physical links. The physical links can be wired or optical links.

In response to an accident involving vehicle 112, onboard unit 130 collects initial accident information from the sensors for vehicle 112. The sensors can send information over the connections. The information can be sent in electrical signals, optical signals, wireless signals, or some combination thereof.

The sensors can include sensors that detect the occurrence of an accident. For example, the sensors can detect when an airbag has been deployed, engagement of an antilock brake system, or the activation of other types of safety devices. The information about operation of other electronic components in vehicle 112 can also be collected through signals sent over the connections. For example, information can be received from sensors in or connected to systems such as an accelerator or throttle, the steering wheel, a brake system, an audio video system, and other components in vehicle 112.

Further, onboard unit 130 can collect information from other devices in or around vehicle 112 such as a smartwatch, a mobile phone, or other device located within a selected distance of the location of the accident. Some or all of this information can be collected as soon as an accident involving vehicle 112 is detected by onboard unit 130. In the illustrative examples, the onboard units in different automobiles can be programmed to collect the some or all available information in response to detecting the occurrence of accident.

Further, onboard unit 130 can also protect the information that is collected from vehicle 112. For example, an alteration protection mechanism can be applied to the collected data. For example, a hash value can be generated from all the information or hash values can be generated for different portions of the information collected by onboard units 130. This hash value can be used to ensure that the data collected does not change when later retrieved for analysis. Further, the information can be encrypted to ensure that the data remains private unless specifically shared or provided to an interested party.

As depicted, onboard unit 130 can also determine an initial severity of the accident from the information collected. In accessing the severity of the accident, onboard units 130 can analyze information such as a global positioning system position, acceleration information, a number of and which airbags have been triggered, an audio recording, a video recording, and other suitable information. Further, the information analyzed to determine the initial severity can also include information collected from devices for occupants of vehicle 112. For example, information such as heart rate, blood pressure, body temperature, and other suitable information can be obtained from devices such as a smartwatch. This information, including health information, is considered protected health information in the illustrative examples and can be collected from devices for the occupants only when the occupants have provided consent for the collection and sharing of health information. In this illustrative example, the consent is obtained ahead of time with the proper disclosure and consent form that follow privacy rules and regulations, such as the Health Insurance Portability and Accountability Act of 1996. In the illustrative example, health information is not collected or shared unless an occupant has opted in to share the information.

In this illustrative example, onboard unit 130 can send vehicle notification 132 to a distributed network such as blockchain network 134 within network 102 based on this initial accident information 136 collected by onboard unit 130. This vehicle notification can include a portion or all of initial accident information 136 depending on the available bandwidth to transmit vehicle notification 132 to blockchain network 134. If only a portion of initial accident information 136 is sent, the remaining portion of initial accident information 136 can be sent at another time when additional bandwidth is available. In this illustrative example, the portion sent can include information needed to start processing the accident for the interested parties 138.

For example, the portion of initial accident information 136 can include an accident location, a vehicle identifier, an identification of occupants in the vehicle, and the first assessment of the severity of the accident. Interested parties 138 are any parties that use accident information to act on the accident and can include, for example, a fire department, a police department, an insurance company, a hospital, an automobile repair ship, a towing company, and other interested parties that can use the accident information.

In response to receiving vehicle notification 132, a blockchain can be created within blockchain network 134 for the accident. In this example, initial accident information 136 is stored as a record in the blockchain created for the accident. In other illustrative examples, the blockchain record is for vehicle 112. Further, blockchain network 134 can send vehicle notification 132 to interested parties 138.

Interested parties 138 can access initial accident information 136 in blockchain network 134 with the proper permission through push or pull mechanisms. For example, the vehicle notification with initial accident information 136 can be automatically sent to interested parties 138. In other illustrative examples, interested parties 138 may receive a message over a network connection indicating that an accident has occurred. Interested parties 138 can then request access to initial accident information 136.

In this illustrative example, blockchain network 134 can search for client devices 110 that are nearby the location of the accident for vehicle 112. For example, blockchain network 134 can search for client devices 110 that were within some selected distance of the location of the accident. This search for client devices 110 can be initiated in response to blockchain network 134 receiving vehicle notification 132.

Further, the search can be for client devices 110 that were within a selected distance of the location within a period of time that includes the time of the accident. For example, blockchain network 134 can search for client devices that were within the selected distance that were present during at least one of before, during, or after the accident. At least one of traffic camera 114, automobile 116, mobile phone 118, body camera 120, or smart glasses 122 may have been within the selected distance from the location of the accident within the period of time. These client devices can send additional accident information 140 to blockchain network 134. Further, an alteration protection mechanism can be applied to additional accident information 140 by these client devices.

These client devices can have a smart contract with blockchain network 134 that causes the client devices to send additional accident information 140. The smart contract to provide the users of these of devices incentives such as discounts, compensation, or other incentives to provide accident information.

In this illustrative example, blockchain network 134 can add additional accident information 140 from client devices 110 as one or more additional blocks in the blockchain for the accident. Additional accident information 140 from each client device and client devices 110 can be added as a separate block in the blockchain for the accident.

In this illustrative example, blockchain network 134 can then perform a second assessment of the severity of the accident using initial accident information 136 and additional accident information 140. Based on the second assessment of the severity of the accident, interested party notification 142 of the accident can be sent to interested parties 138. Interested party notification 142 can include information from the second assessment made using initial accident information 136 and additional accident information 140.

Thus, the onboard computer in vehicle 112 can perform a first assessment of the severity of the accident. Based on the severity, initial notifications can be made to interested parties 138. Blockchain network 134 functions to store initial accident information 136. Further, blockchain network 134 also functions to collect additional accident information 140 from other client devices.

Additionally, blockchain network 134 performs a second assessment of the severity of the accident. With the second assessment, notifications can be made to interested parties 138. Depending on whether the second assessment changes from the first assessment, different parties in interested parties 138 can be identified for notification. For example, if the accident is considered to be more severe in the second assessment, additional interested parties can be notified. For example, a hospital in the health insurance company may be notified if the severity of the accident increases to include an injury.

Figure 2:
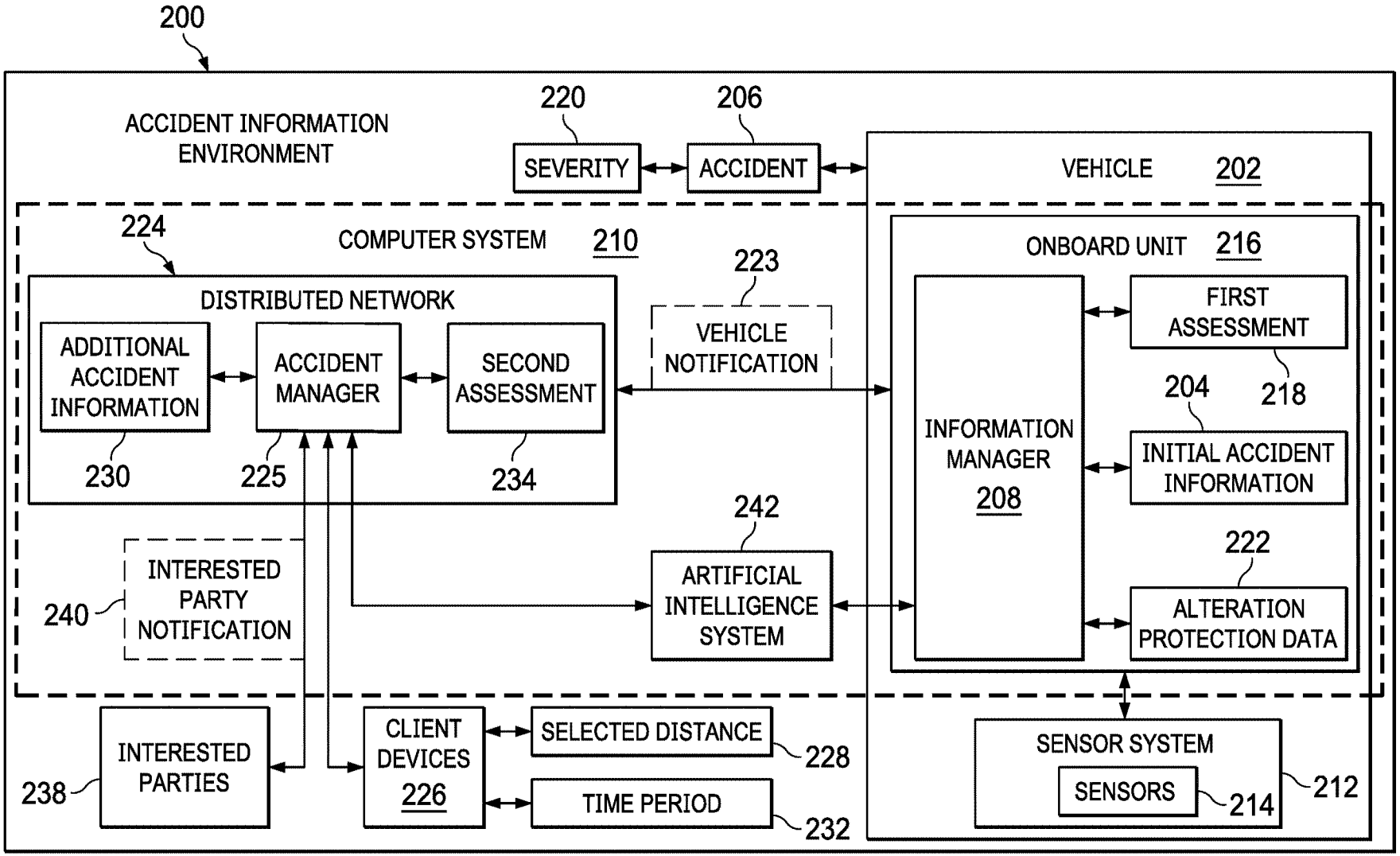
FIG. 2 is a block diagram of an accident information environment in accordance with an illustrative embodiment.

With reference now to FIG. 2, a block diagram of an accident information environment is depicted in accordance with an illustrative embodiment. In this illustrative example, accident information environment 200 includes components that can be implemented in hardware such as the hardware shown in network data processing system 100 in FIG. 1.

As depicted, vehicle 202 can provide initial accident information 204 if vehicle 202 is involved in accident 206. Vehicle 202 can take a number of different forms. For example, vehicle 202 can be an automobile, a crossover vehicle, a sport-utility vehicle, a truck, a bus, a semi-trailer truck, a sports car, a motorcycle, or some other suitable type of vehicle In this illustrative example, initial accident information 204 is obtained by information manager 208 in computer system 210 in vehicle 202 using sensor system 212. Initial accident information 204 comprises at least one of global positioning system data, a speed, accelerometer data, air bag state, a video recording, an audio recording, heart rate of an occupant, blood pressure of an occupant, temperature of an occupant, or other suitable information needed to evaluate or analyze accident 206. The collection of initial accident information 204 can include health information for individuals that is considered protected health information. Health information can be collected from devices for the occupants only when the occupants have provided consent for the collection and sharing of health information. In this illustrative example, the consent is obtained ahead of time with the proper disclosure and consent forms for privacy rules and regulations, such as the Health Insurance Portability and Accountability Act of 1996. In the illustrative example, health information is not collected or shared unless an occupant has opted in to share the health information. Further, any other personal information about the occupant is not collected or shared without the occupant opting in by providing consent to the collection and use of the personal information. For example, audio recordings or video recordings of an occupant are not collected or shared without the occupant opting in to the collection of sharing of this type of information.

As depicted, information manager 208 runs on the portion of computer system 210 in vehicle 202. Computer system 210 is a physical hardware system and includes one or more data processing systems. When more than one data processing system is present in computer system 210, those data processing systems are in communication with each other using a communications medium. The communications medium can be a network. The data processing systems can be selected from at least one of a computer, a server computer, a tablet computer, or some other suitable data processing system. In this example, the portion of computer system 210 in vehicle 202 is onboard unit 216, which is a computer built into, integrated in, or physically connected to vehicle 202.

In this illustrative example, sensor system 212 is a physical hardware system and may also include software. As depicted, sensor system 212 includes sensors 214 that are built into, integrated in or connected to vehicle 202. For example, sensors 214 can be selected from at least one of a microphone, a global positioning system (GPS), an accelerometer, an inertial measurement unit, an altimeter, a thermometer, a digital camera, or other suitable types of devices.

As depicted, sensors 214 can also include devices within or proximate to vehicle 202. For example, a smartwatch, a mobile phone, or other type of client device can be a sensor in sensors 214. In one illustrative example, a smartwatch includes sensors such as a digital camera, thermometer, an accelerometer, a heartbeat monitor, an altimeter, a global positioning system receiver, and other devices that can generate sensor information. In another example, a mobile phone includes a microphone, a digital camera, accelerometers, and other suitable devices that can generate sensor information.

This sensor information, that a device, such a smart watch, can generate, can include health information which is considered protected health information in the illustrative examples and can be collected from devices for the occupants only when the occupants have provided consent for the collection and sharing of health information. In this illustrative example, the consent is obtained ahead of time with the proper disclosure and consent forms for privacy rules and regulations. In the illustrative example, health information is not collected or shared unless an occupant has opted in to share the health information. Further, any other personal information about the occupant is not collected or shared without the occupant opting in by providing consent to the collection and use of the personal information.

As depicted, distributed network 224 comprises computing devices such as a desktop computer, a server computer, a mobile phone, a tablet computer, an onboard unit in a vehicle, a laptop computer, or other suitable computing devices that are capable of communicating with onboard unit 216 in vehicle 202 and receiving information from onboard unit 216. In the illustrative examples, these communications are facilitated using wireless connections selected from at least one of Wi-Fi, Bluetooth, infrared signals, cellular signals, or other wireless signals. These connections may be designed for communications over short distances or longer distances.

As depicted, when accident 206 is detected for vehicle 202, information manager 208 running on onboard unit 216 in computer system 210 collects selected information in the form of initial accident information 204 from sensor system 212 for vehicle 202. In this illustrative example, information manager 208 determines first assessment 218 of severity 220 of accident 206 using initial accident information 204.

The selected information that forms initial accident information 204 can be some or all of the information generated by sensor system 212. This information can include data generated by sensors 214 and information determined or preprocessed from the data generated by sensors 214. When some of the information from sensor system 212 is selected, the selection of information to form the selected information that is collected can be based on a policy or can be information preselected parameters. For example, the selected information can include at least one of a speed, a location, whether airbag has been triggered, which airbags have been triggered, health information for occupants, or other suitable information. In the illustrative examples, health information is considered protected health information, in the illustrative examples, and can be collected from devices for the occupants only when the occupants have provided consent for the collection and sharing of health information. In this illustrative example, the consent is obtained ahead of time with the proper disclosure and consent. In the illustrative example, health information is not collected or shared unless an occupant has opted in to share the health information. Further, any other personal information about the occupant is not collected or shared without the occupant opting in by providing consent to the collection and use of the personal information.

Selected information can be based on information that is needed to collect additional accident information 230 from client devices 226. As another example, selected information can also information needed to perform initial notifications to the parties 238.

In this illustrative example, first assessment 218 of severity 220 of accident 206 can be performed using artificial intelligence system 242 that has been trained using simulator and historical vehicle accident data. An artificial intelligence system is a system that has intelligent behavior and can be based on function of the human brain. An artificial intelligence system comprises at least one of an artificial neural network, a cognitive system, a Bayesian network, a fuzzy logic, an expert system, a natural language system, a cognitive system, or some other suitable system. Machine learning is used to train the artificial intelligence system. Machine learning involves inputting data to the processing and allowing the process to adjust and improve the function of the artificial intelligence system. A cognitive system is a computing system that mimics the function of a human brain. The cognitive system can be, for example, IBM Watson available from International Business Machines Corporation.

In one illustrative example, an artificial intelligence system model in artificial intelligence system 242 can be located in onboard unit 216. In other illustrative examples, artificial intelligence system 242 can be located in a data processing system in computer system 210 that is in communication with onboard unit 216.

Additionally, information manager 208 can generate alteration protection data 222 from initial accident information 204. In this illustrative example, alteration protection data 222 is used to determine whether initial accident information 204 has been changed. A number of different types of alteration protection data 222 can be used alone or in combination. For example, alteration protection data 222 is selected from at least one of a hash value, a checksum, a check digit, or some other suitable mechanism for detecting when alteration data has occurred. This alteration can occur from corruption of data, intentional changes, or through other causes.

In one illustrative example, a hash function may be applied to initial accident information 204 to obtain a hash value as alteration protection data 222 for this information. The hash function can be applied to all initial accident information 204 or to pieces of initial accident information 204 in which hash values are obtained for each of the pieces of initial accident information 204. For example, initial accident information 204 can be received from different sensors. A hash value can be generated for data received from the different sensors.

In the illustrative example, information manager 208 sends vehicle notification 223 of accident 206 onto distributed network 224, another portion of computer system 210. As depicted, computer system 210 includes both onboard unit 216 and distributed network 224. In sending vehicle notification 223, information manager can send a portion of initial accident information 204 as part of vehicle notification 223 or as an attachment to vehicle notification 223. Vehicle notification 223 can also include first assessment 218 of severity 220 of accident 206. In this illustrative example, information manager 208 determines the portion of initial accident information 204 to send with vehicle notification 223. The selection of which information in initial accident information 204 is sent can be based on a bandwidth available to send vehicle notification 223 from vehicle 202 to distributed network 224.

Distributed network 224 is another portion of computer system 210 and includes computing devices not located in vehicle 202. Distributed network 224 can take a number of different forms. For example, distributed network 224 can be comprised of different devices that may be mobile or in fixed locations. In this illustrative example, the different devices in distributed network 224 are data processing systems that function to process accident information that is received from different vehicles resources. In one illustrative example, distributed network 224 can be a distributed ledger system such as blockchain network 134 in FIG. 1.

As depicted, accident manager 225 in distributed network 224 searches for a set of client devices 226 located within selected distance 228 from accident 206 in response to vehicle notification 223 of accident 206. Accident manager 225 can be software that is distributed among different computing devices in distributed network 224. The process for searching for a set of client devices 226 can be performed by accident manager 225 using artificial intelligence system 242. In this illustrative example, artificial intelligence system 242 is in communication with accident manager 225.

The client device in client devices 226 can be one in which an application, software, or smart contract is present that runs to submit additional accident information 230. Client devices 226 can be selected from at least one of an automobile with an onboard unit, a traffic camera, a mobile phone carried by a user, the body camera on a police officer, smart glasses worn by a user, a smartwatch worn by a user, or another suitable computing device that is capable of collecting additional accident information 230.

In this illustrative example, selected distance 228 can be selected in a number of different ways. For example, selected distance 228 can be a default distance from the location of accident 206, such as 50, 100 yards, two blocks, 1 mile, or some other distance. Selected distance 228 can also be a distance from the location of accident 206 within a boundary. This boundary can be selected by terrain, or a political value. For example, selected distance 228 can be one mile but within the city limits. As another example, selected distance 228 can be 1 mile in some direction but less than a mile based on a boundary set by a nearby lake. As a result, the area encompassed by selected distance 228 can be a circle, an irregular shape, or some other shape.

Further, the set of client devices 226 within selected distance 228 can be selected by distributed network 224 as the set of client devices 226 within the selected distance within time period 232 including the time at which accident 206 occurred. For example, time period 232 includes the time of accident 206 but can also include a period of time before accident 206, period of time after accident 206, or both the period of time before accident 206 and the period of time after accident 206. The selection of a default period of time can be based on the likelihood of client devices 226 being present to record information about accident 206.

As depicted, accident manager 225 in distributed network 224 requests additional accident information 230 from the set of client devices 226 when the set of client devices 226 are identified as being present within selected distance 228 from accident 206. In this illustrative example, additional accident information 230 comprises at least one of traffic information, an accident report, an additional video recording, an additional audio recording, an image, a witness report, or other suitable information that can be collected from the set of client devices relating to accident 206. Other information can also include biometric information such as heartrate, temperature, blood pressure, or other information. The biometric information can be considered protected health information in the illustrative examples and can be collected from devices for the occupants only when the occupants have provided consent for the collection and sharing of health information. In this illustrative example, the consent is obtained ahead of time with the proper disclosure and consent forms. In the illustrative example, biometric information is not collected or shared unless an occupant has opted in to share this information. Further, any other personal information about the occupant is not collected or shared without the occupant opting in by providing consent to the collection and use of the personal information.

In this illustrative example, additional accident information 230 may be automatically sent upon request depending on the application, mobile application, or particular smart contract used. In other illustrative examples, additional accident information 230 can be automatically sent using an application on a smart device based on user input selecting and approving the sending of additional accident information 230 located on a client device for the user. For example, a user may select and send particular photographs recorded by a digital camera in a mobile phone. In other illustrative examples, an application on the mobile phone may perform object recognition to identify images of vehicle 202 and accident 206, images of the location of accident 206, and other suitable images.

In this illustrative example, client devices 226 sends additional accident information 230 to distributed network 224. As depicted, accident manager 225 in distributed network 224 can store additional accident information 230 along with initial accident information 204.

Accident manager 225 can determine second assessment 234 of severity 220 of accident 206 using initial accident information 204 and additional accident information 230 received from the set of client devices 226. Accident manager 225 can perform second assessment 234 using artificial intelligence system 242. In this illustrative example, second assessment 234 is a more complete assessment of severity 220 of accident 206 because this assessment is performed with the benefit of additional accident information 230. For example, second assessment 234 of severity 220 of accident 206 can include effects on traffic conditions, injuries to parties in other vehicles or pedestrians, or other conditions or situations that were not identifiable in first assessment 218 using initial accident information 204.

Accident manager 225 sends interested party notification 240 including second assessment 234 to a set of interested parties 238 based on second assessment 234 of severity 220 of accident 206. For example, first assessment 218 can have a severity level of property damage, interested party notification 240 that is sent to a set of interested parties 238 that includes an automobile insurance company and a repair shop. When second assessment 234 is made and increases the severity level to indicate injuries, the set of interested parties 238 can be updated to include a health insurance company.

Information manager 208 and accident manager 225 can be implemented in software, hardware, firmware or a combination thereof. When software is used, the operations performed by information manager 208 and accident manager 225 can be implemented in program code configured to run on hardware, such as a processor unit. When firmware is used, the operations performed by information manager 208 can be implemented in program code and data and stored in persistent memory to run on a processor unit. When hardware is employed, the hardware may include circuits that operate to perform the operations in information manager 208 and accident manager 225.

In the illustrative examples, the hardware may take a form selected from at least one of a circuit system, an integrated circuit, an application specific integrated circuit (ASIC), a programmable logic device, or some other suitable type of hardware configured to perform a number of operations. With a programmable logic device, the device can be configured to perform the number of operations. The device can be reconfigured at a later time or can be permanently configured to perform the number of operations. Programmable logic devices include, for example, a programmable logic array, a programmable array logic, a field programmable logic array, a field programmable gate array, and other suitable hardware devices. Additionally, the processes can be implemented in organic components integrated with inorganic components and can be comprised entirely of organic components excluding a human being. For example, the processes can be implemented as circuits in organic semiconductors.

Figure 3:
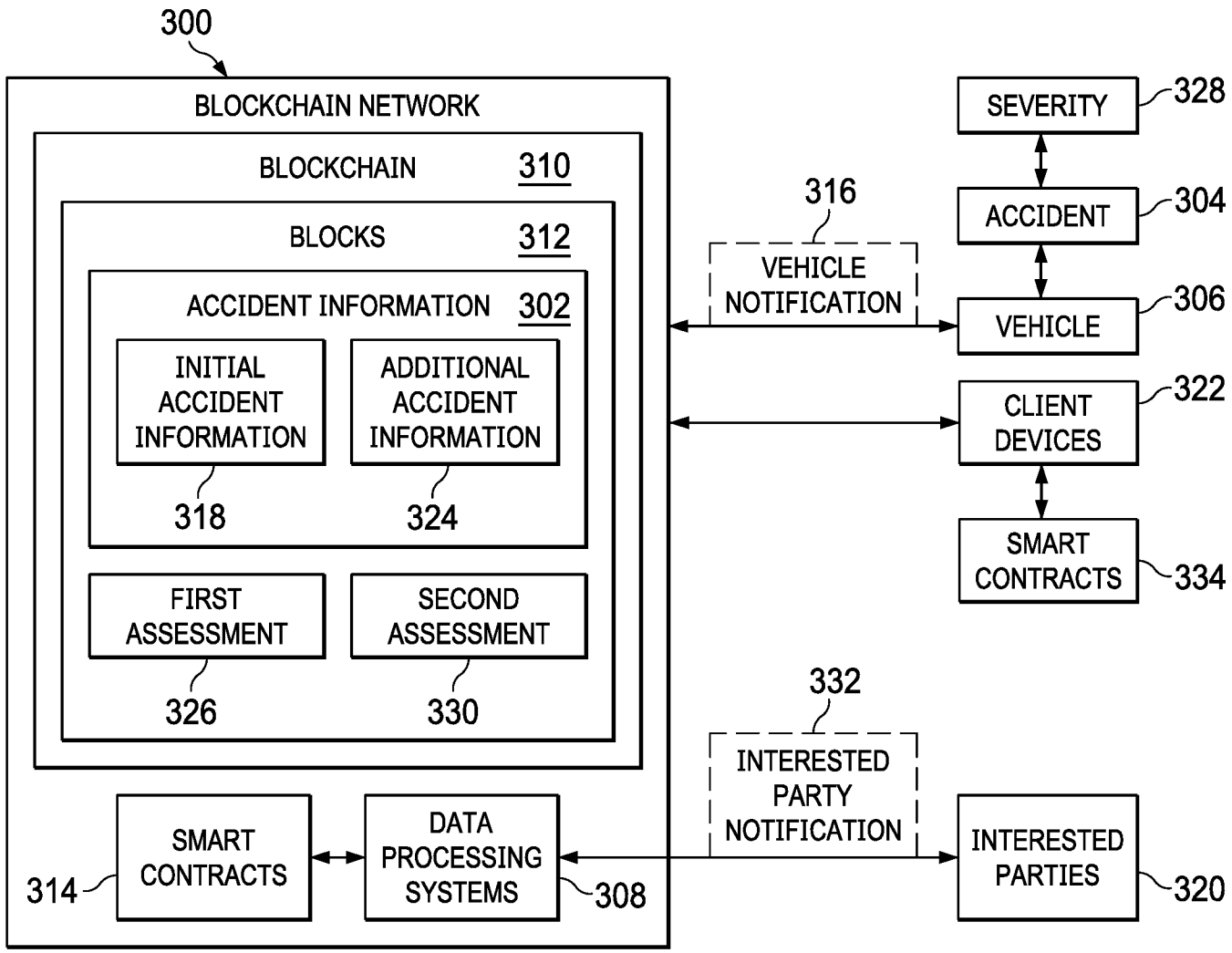
FIG. 3 is a block diagram of a blockchain network for storing accident information in accordance with an illustrative embodiment.

With reference next to FIG. 3, a block diagram of a blockchain network for storing accident information is depicted in accordance with an illustrative embodiment. In this illustrative example, blockchain network 300 is an example of an implementation for blockchain network 134 in FIG. 3 and is an example of one manner in which distributed network 224 in FIG. 2 can be implemented.

As depicted, blockchain network 300 is used to store accident information 302 for accident 304 involving vehicle 306. Blockchain network 300 is a peer-to-peer network in which data processing systems 308 in blockchain network 300 manage blockchain 310. In this illustrative example, blockchain 310 is a distributed data structure that contained blocks 312 that are replicated and shared among data processing system 308 in blockchain network 300. Each block in blocks 312 in blockchain 310 carries a list of transactions in a chain where each block is hashed to a previous block. The exception to this hashed to the previous block list structure is the first block in blocks 312 which is the genesis block and is common to all data processing systems 308 in blockchain network 300.

Data processing systems 308 use a protocol for inter-node communication in which each data processing system represents a node in blockchain network 300 in this illustrative example. In some illustrative examples, more than one data processing system can form a node. This protocol is also used by data processing systems 308 to validate new blocks in blockchain 310 for accident 304.

In this illustrative example, smart contracts 314 include contractual clauses that have been translated into code run on data processing systems 308. Smart contracts 314 define the performance of functions by data processing system 308 and can include how data processing systems 308 are compensated. In this illustrative example, smart contracts 314 are in the form of software code that are run by data processing systems 308. The software code is also stored in blockchain 310 in this example.

In this illustrative example, the computations performed by data processing systems 308 using smart contracts 314 include receiving vehicle notification 316 with initial accident information 318 from vehicle 306, storing initial accident information 318, sending vehicle notification 316 to a set of interested parties 320. Further, smart contracts 314 can also run to cause data processing system 308 to locate client devices 322 within a selected distance from the location of accident 304. Client devices 322 can also run smart contracts 334 that cause client devices 322 to transmit additional accident information 324 to blockchain network 300. Users of client devices 322 can be given incentives to use smart contracts 334. For example, incentives can include discounts, rebates, renumeration, or other types of incentives. These incentives can be offered by parties who need or use additional accident information 324.

As depicted, additional accident information 324 is also stored in blocks 312 in blockchain 310. Initial accident information 318 and additional accident information 324 form accident information 302 stored in blockchain 310 in blockchain network 300.

Initial accident information 318 can include first assessment 326 of severity 328 of accident 304. In this illustrative example, data processing systems 308 determine second assessment 330 of severity 328 of accident 304. The second assessment may be used to send interested party notification 332 to interested parties 320.

With the use of the blockchain 310, the different operations can be performed with confidence that accident information 302 is accurate and has not been changed during the process of collecting accident information 302 and analyzing accident information 302. Vehicle notification 316 and interested party notification 332 sent to interested parties 320 can include the assessments made using the accident information or may merely provide notification that accident information 302 is available for access.

In one illustrative example, one or more technical solutions are present that overcome a technical problem with managing accident information in response to the occurrence of an accident involving a vehicle. As a result, one or more technical solutions may provide a technical effect providing a more efficient and complete processing of accident information for vehicle accidents. In one illustrative example, one or more technical solutions collect and store initial accident information using a data processing system in a vehicle such as an onboard unit in response to detecting the occurrence of an accident using a sensor system for the vehicle. This collection is performed as soon as possible to avoid a loss of data. Further, one or more technical solutions ensure the integrity of the data using alteration protection data. For example, one or more technical solutions apply a hash function to the initial accident information to generate hash values that can be used to ensure that the initial accident data does not change over time or when transmitted.

Computer system 210 can be configured to perform at least one of the steps, operations, or actions described in the different illustrative examples using software, hardware, firmware or a combination thereof. As a result, computer system 210 operates as a special purpose computer system in which at least one of information manager 208 or accident manager 225 in computer system 210 enables processing of accident information generated by vehicle. In particular, at least one of information manager 208 or accident manager 225 transforms computer system 210 into a special purpose computer system as compared to currently available general computer systems that do not have at least one of information manager 208 or accident manager 225.

In the illustrative example, the use of at least one of information manager 208 or accident manager 225 in computer system 210 integrates processes into a practical application for method processing accident information for vehicle that increases the performance of computer system 210. In this example, the performance of computer system 210 can be increased by increasing the amount of accident data that can be obtained to process a vehicle accident.

Further, the performance of computer system 210 can be increased enabling detecting whether accident data has been altered.

The illustration of accident information environment 200 in the different components in FIGS. 2-3 is not meant to imply physical or architectural limitations to the manner in which an illustrative embodiment can be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment.

For example, computer system 210 in FIG. 2 can include one or more onboard units in one or more vehicles in addition to onboard unit 216 in vehicle 202. Additionally, computer system 210 can also include one or more additional distributed networks in addition to distributive network 224. When more than one distributed network is present, these distributed networks can be in the same or different types. First, one distributed network can be a blockchain network while another distributed network can be an ad hoc network or a local area network.

As another example, although the illustrative examples describe using a blockchain, such as blockchain 310, other types of distributed ledgers can be used. In the illustrative example, a distributed ledger is a consensus of replicated, shared, and synchronize data spread across multiple sites, countries, or institutions. A centralized administrator or centralized data storage is absent in a distributed ledger such as blockchain 310 in blockchain network 300. In other words, other illustrative examples can employ any type of distributed ledger in addition to or in place of blockchain 310 in FIG. 3. As another example, artificial intelligence system 242 can be implemented as part of accident manager 225 instead of being in communication with accident manager 225.

Figure 4:
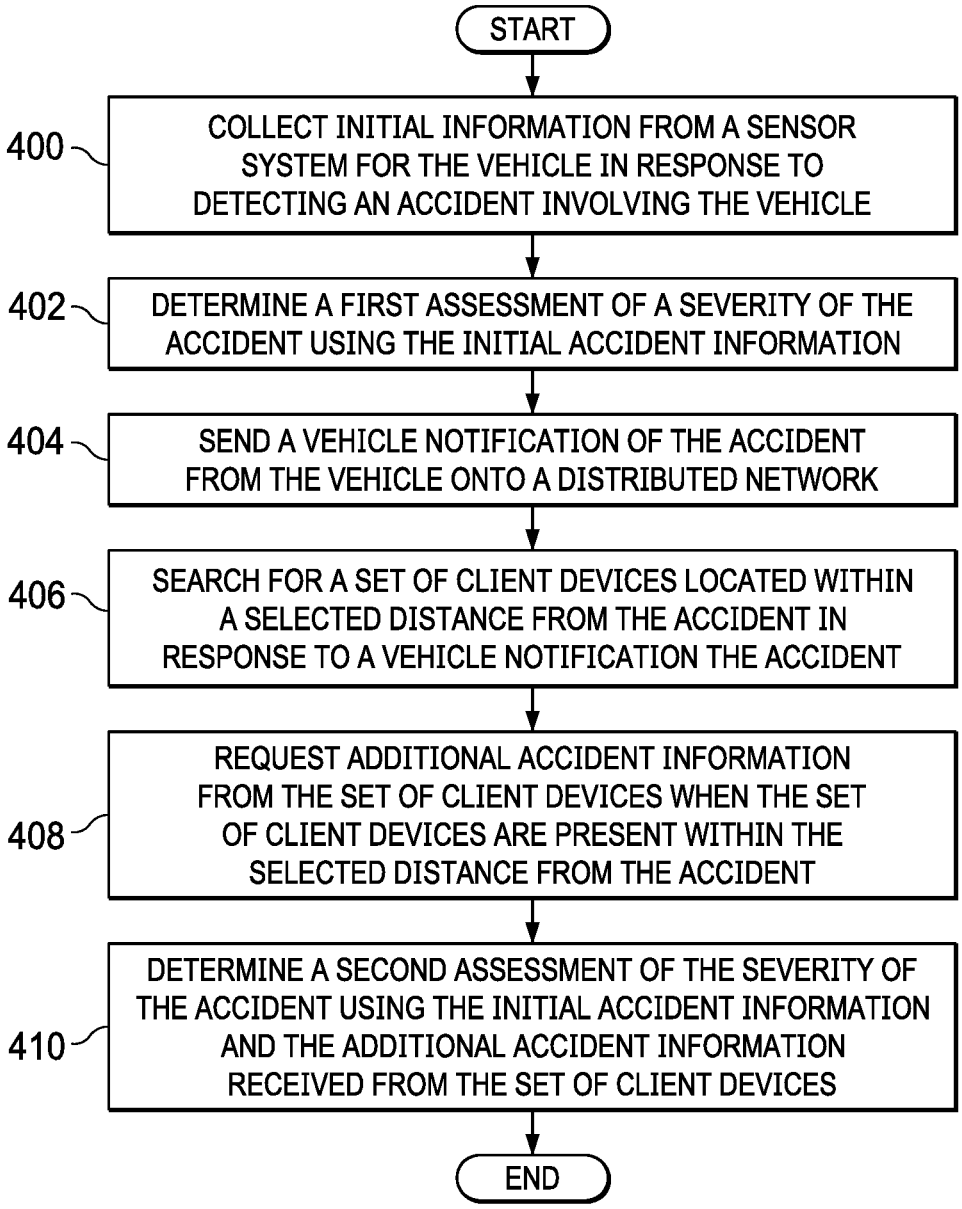
FIG. 4 is a flowchart of a process for processing accident information for a vehicle in accordance with an illustrative embodiment.

Turning next to FIG. 4, a flowchart of a process for processing accident information for a vehicle is depicted in accordance with an illustrative embodiment. The process in FIG. 4 can be implemented in hardware, software, or both. When implemented in software, the process can take the form of program code that is run by one of more processor units located in one or more hardware devices in one or more computer systems. For example, the process can be implemented in computer system 210 in FIG. 2.

The process begins by collecting initial information from a sensor system for the vehicle in response to detecting an accident involving the vehicle (step 400). The process determines a first assessment of a severity of the accident using the initial accident information (step 402). For example, the assessment can include a determination of vehicle damage, potential injuries, property damage, and other suitable determinations made using the initial accident information. The process sends a vehicle notification of the accident from the vehicle onto a distributed network (step 404). In the illustrative example, the vehicle notification includes at least some of the initial accident information. Sending the notification to the distributed network can cause the distributed network to send an initial interested party notification to a set of interested parties based on the first assessment of the severity of the accident when the first assessment is included in the vehicle notification. In this illustrative example, step 400, step 402, and step 404 can be performed by information manager 208 in onboard unit 216 in computer system 210 in FIG. 2.

The process searches for a set of client devices located within a selected distance from the accident in response to the vehicle notification of accident (step 406). The process requests additional accident information from the set of client devices when the set of client devices are present within the selected distance from the accident (step 408). The process determines a second assessment of the severity of the accident using the initial accident information and the additional accident information received from the set of client devices (step 410). The process terminates thereafter. As depicted, step 406, step 408, and step 410 can be performed by accident manager 225 in distributed network 224 in computer system 210.

Figure 5:
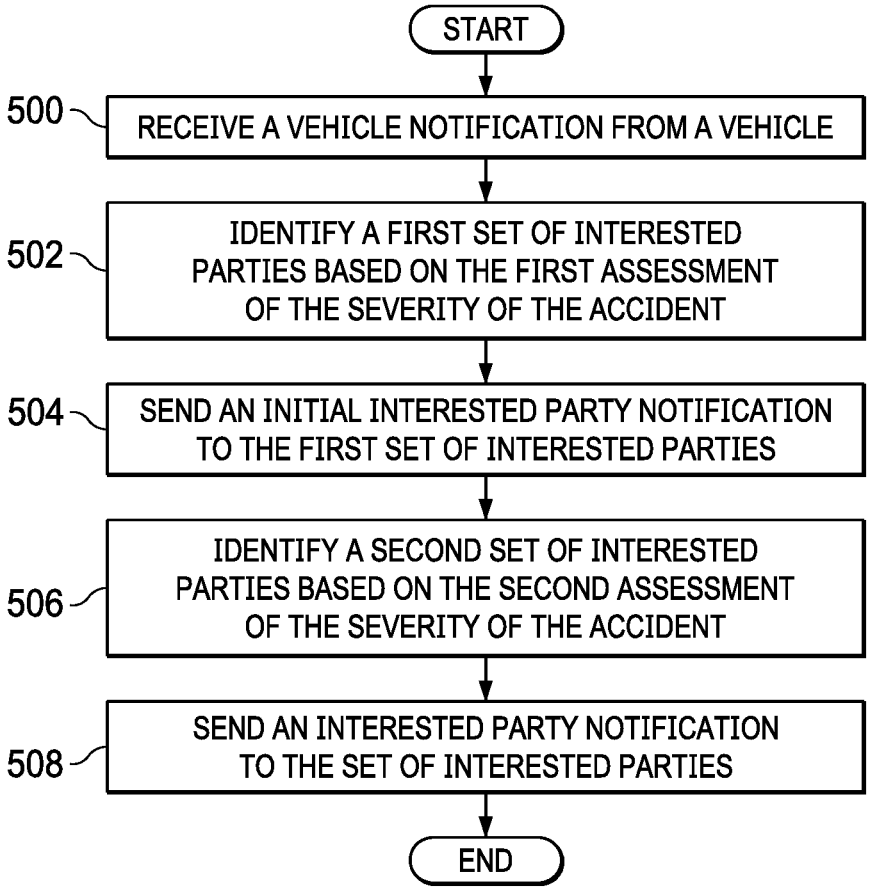
FIG. 5 is a flowchart of a process for sending notifications regarding accident information for a vehicle in accordance with an illustrative embodiment.

Turning next to FIG. 5, a flowchart of a process for sending notifications regarding accident information for a vehicle is depicted in accordance with an illustrative embodiment. The process in FIG. 5 can be implemented in hardware, software, or both. When implemented in software, the process can take the form of program code that is run by one of more processor units located in one or more hardware devices in one or more computer systems. For example, the process can be implemented in computer system 210 in FIG. 2. In this illustrative example, the process can be performed by accident manager 225 in distributed network 224 in FIG. 2.

The process receives a vehicle notification from a vehicle (step 500). The notification in step 500 can also include at least one of alteration protection data, initial accident information, a first assessment of the severity of the accident, or other suitable information. The process identifies a first set of interested parties based on the first assessment of the severity of the accident (step 502). The first set of interested parties can be a standard set of parties based on the location of the accident. For example, a standard set of parties can be a law enforcement agency, a paramedic service, and a hospital. The selection of a particular law enforcement agency, a paramedic service, a towing service, and a hospital can be based on the location of the accident. The parties are selected as ones that would service or cover the location in which the accident occurred.

As another example, the first set of parties can also be based on an identification of an insurance company providing insurance for the vehicle. The identification of the insurance company can be made using a database that identifies insured vehicles based on vehicle identification numbers. As another example, the first set of interested parties can be one or more persons designated for notification of an accident in which user preferences made by the driver or other occupants are present. These designations can be made when the driver or other occupants opt in to have these persons notified in the event of an accident.

The process sends an initial interested party notification to the first set of interested parties (step 504). The initial notification can identify an insured party, a vehicle identification number, an accident location, or other suitable information. The vehicle notification can also include the first assessment of the severity of the accident. For example, the assessment can include a determination vehicle damage, potential injuries, property damage, and other suitable determinations made using the initial accident information.

When a second assessment of the severity has been made using the initial accident information and additional accident information, the process identifies a second set of interested parties based on the second assessment the severity of the accident (step 506). The second set of interested parties can be the same interested parties as the first set of interested parties or contain different interested parties depending on the second assessment of the severity of the accident. If the second assessment of the severity of accident changes from the first assessment, second set of interested parties can be different from the first set of interested parties. The process sends an interested party notification to the second set of interested parties (step 508). The process terminates thereafter.

Figure 6:
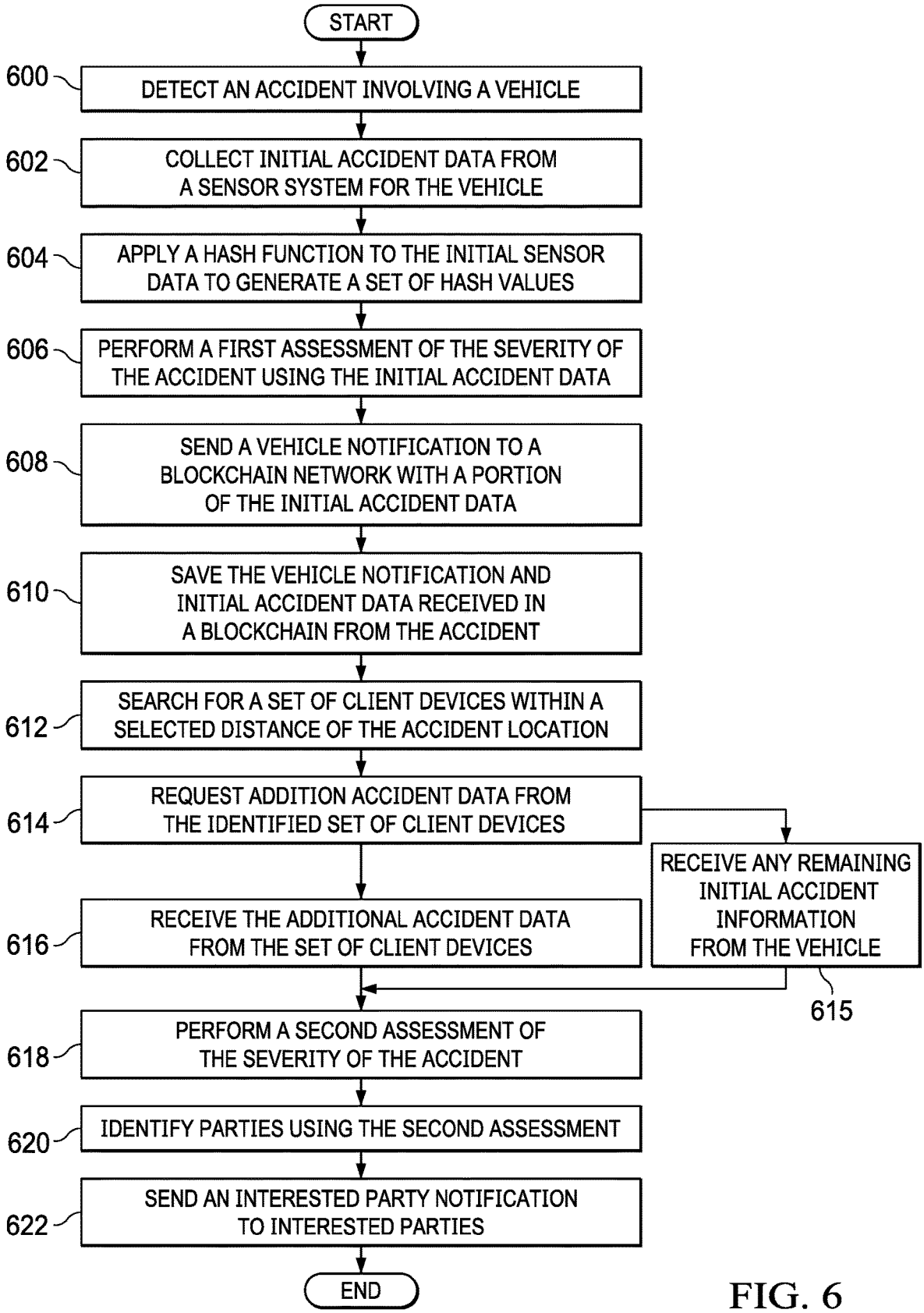
FIG. 6 is a more detailed flowchart of a process for processing accident information for a vehicle in accordance with an illustrative embodiment.

Turning next to FIG. 6, a more detailed flowchart of a process for processing accident information for a vehicle is depicted in accordance with an illustrative embodiment. The process in FIG. 6 can be implemented in hardware, software, or both. When implemented in software, the process can take the form of program code that is run by one of more processor units located in one or more hardware devices in one or more computer systems. For example, the process can be implemented in computer system 210 in FIG. 2. In this illustrative example, the process can be performed by components in computer system 210 such as information manager 208 in onboard unit 216 in vehicle 202 and accident manager 225 in distributed network 224 in FIG. 2.

The process begins by detecting an accident involving a vehicle (step 600). In step 600, the accident can be detected from sensor data generated by a sensor system. For example, sensor data can be received from airbag activators, accelerometers, and other suitable sensors that generate data indicating the occurrence of an accident.

The process collects initial accident data from a sensor system for the vehicle (step 602). Information the vehicle generates just before, during, and just after the accident can be saved in the vehicle, such as a local memory for an onboard unit.

The data can also include information indicating the health conditions of occupants in the vehicle. For example, information from smart watches, voice recognition systems, mobile phones, and other devices can be saved. This initial accident information, including information about health conditions of the occupants, is considered protected health information in the illustrative examples and can be collected from devices for the occupants only when the occupants have provided consent for the collection and sharing of health conditions. In the illustrative example, information about health conditions are not collected or shared unless an occupant has opted in to share the information about health conditions. Further, any other personal information about the occupant is not collected or shared without the occupant opting in by providing consent to the collection and use of the personal information.

These devices can be connected to and in communication using wireless connections with the onboard unit in the vehicle. The process applies a hash function to the initial sensor data to generate a set of hash values (step 604).

The process performs a first assessment of the severity of the accident using the initial accident data (step 606). The assessment can be performed using machine learning models or other artificial intelligence systems. For example, the severity of accident can be low-impact, medium impact, high-impact, low-impact with injury, medium impact with injury, high-impact with injury, low-impact without injury, medium impact without injury, high-impact without injury, or some other description of the severity of the accident. The assessment of the severity can also include, for example, the number of people involved, conditions of passengers, or other suitable information. The severity can be used to prioritize accident notification and determine the amount and type of information that should be uploaded as soon as possible and identify information that can be uploaded when more favorable conditions are present.

The process sends a vehicle notification to a blockchain network with a portion of the initial accident data (step 608). In this illustrative example, the vehicle notification can include the first assessment of the severity of the accident. The portion of the initial accident data selected depends on, for example, the first assessment of the severity and the amount of bandwidth available to transmit the data to the blockchain network.

The portion of the initial accident information selected includes information needed for the process of collecting additional accident information. The initial accident information can also include information needed to notify interested parties. For example, the location of the vehicle, vehicle identification, occupant identification, severity of the accident, and hash codes can be sent in the portion of the data transmitted with the vehicle notification. In some cases, the portion can be all of the initial accident data.

In response to receiving the vehicle notification with the portion of the initial accident data at the blockchain network, the process saves the vehicle notification and initial accident data received in a blockchain for the accident (step 610). In response to receiving the vehicle notification at the blockchain network, the process searches for a set of client devices within a selected distance of the accident location (step 612). In step 612, the search can include algorithms that search for the set of client devices based on vehicular adhoc network (VANET) triangularizations.

The process requests additional accident data from the identified set of client devices (step 614). The process receives the additional accident data from the set of client devices (step 616). In step 616, additional accident data can include video recordings and audio recordings from surveillance cameras, sensor information from other vehicles to identify traffic conditions, biometric information from smartwatches of users in the area of the accident, photos, reports, and identification of witnesses from smart phones operated by police officers, and other suitable data.

The process also receives any remaining initial accident information from the vehicle (step 615). This step is performed in parallel to step 616 and can be performed when all of the initial accident data is not sent with the vehicle notification. The functions in step 610, step 612, step 614, and step 616 are trigged by receiving the vehicle notification as part of a first type smart contract in the blockchain network.

In response to receiving the additional accident data from the set of client devices, the process performs a second assessment of the severity of the accident (step 618). The second assessment can also be performed using a machine learning model or other type of artificial intelligence system. In step 618, the assessment can also identify additional information that may be needed to handle the accident that was not identified using the initial accident information in the first assessment. For example, the second assessment can also identify whether additional injuries outside the vehicle occurred, traffic issues, or other situations caused by the accident.

The process identifies interested parties using the second assessment (step 620). This identification can supplement or change the interested parties identified by the first assessment in the vehicle notification. The process sends an interested party notification to interested parties (step 622). The process terminates thereafter.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent at least one of a module, a segment, a function, or a portion of an operation or step. For example, one or more of the blocks can be implemented as program code, hardware, or a combination of the program code and hardware. When implemented in hardware, the hardware may, for example, take the form of integrated circuits that are manufactured or configured to perform one or more operations in the flowcharts or block diagrams. When implemented as a combination of program code and hardware, the implementation may take the form of firmware. Each block in the flowcharts or the block diagrams can be implemented using special purpose hardware systems that perform the different operations or combinations of special purpose hardware and program code run by the special purpose hardware.

In some alternative implementations of an illustrative embodiment, the function or functions noted in the blocks may occur out of the order noted in the figures. For example, in some cases, two blocks shown in succession can be performed substantially concurrently, or the blocks may sometimes be performed in the reverse order, depending upon the functionality involved. Also, other blocks can be added in addition to the illustrated blocks in a flowchart or block diagram.

For example, step 612 can be performed before step 610. In another example, step 610 and step 612 can be performed at the same time. In yet another illustrative example, the process in FIG. 6 can include sending the vehicle notification to a set of interested parties based on the severity of the accident determined by the first assessment.

Figure 7:
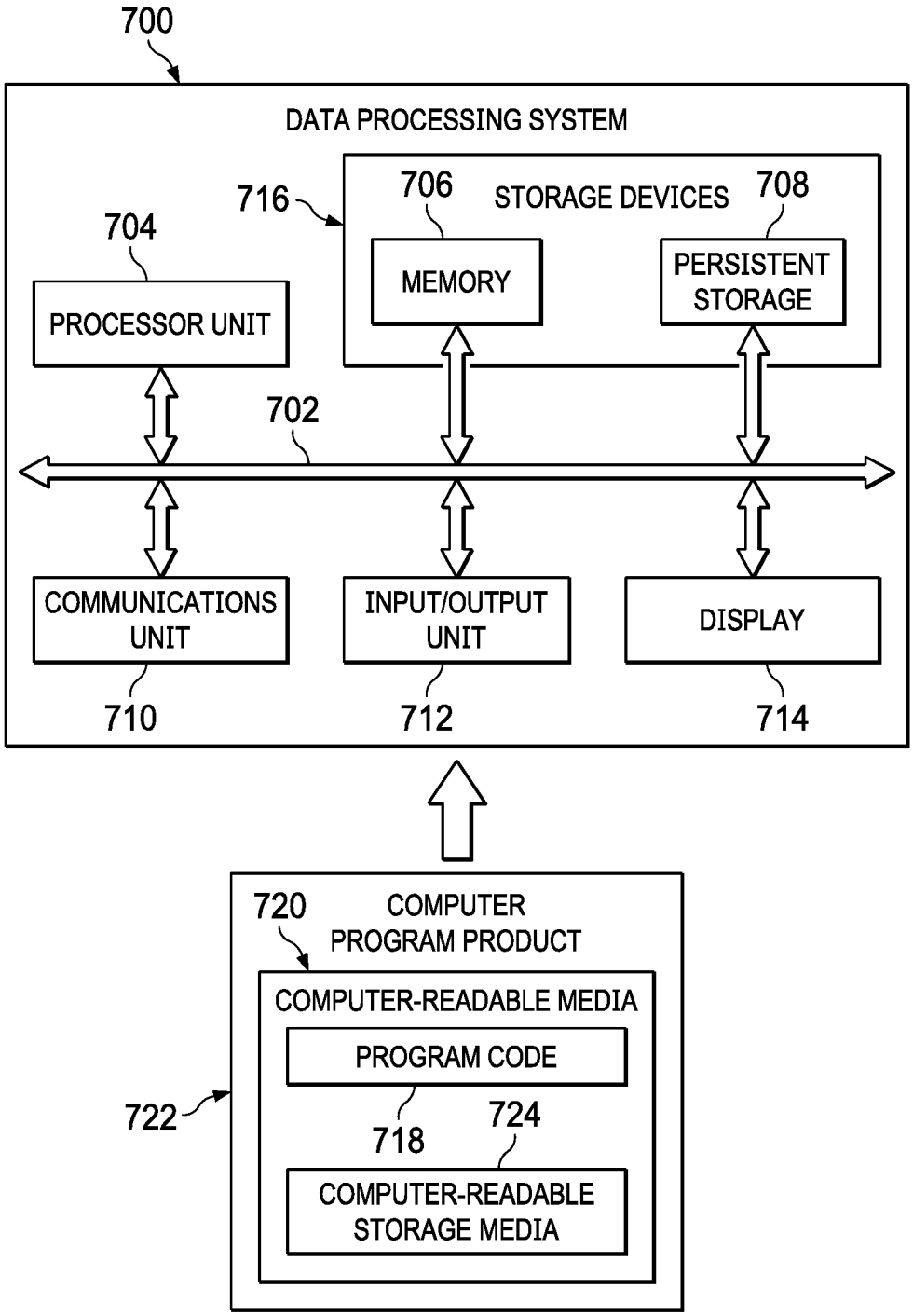
FIG. 7 is a block diagram of a data processing system in accordance with an illustrative embodiment.

Turning now to FIG. 7, a block diagram of a data processing system is depicted in accordance with an illustrative embodiment. Data processing system 700 can be used to implement server computer 104, server computer 106, client devices 110, in FIG. 1. Data processing system 700 can also be used to implement computer system 210 and client devices 226 in FIG. 2. For example, data processing system 700 can be used to implement onboard unit 216 and the different components in distributed network 224 in computer system 210 in FIG. 2.

In this illustrative example, data processing system 700 includes communications framework 702, which provides communications between processor unit 704, memory 706, persistent storage 708, communications unit 710, input/output (I/O) unit 712, and display 714. In this example, communications framework 702 takes the form of a bus system.

Processor unit 704 serves to execute instructions for software that can be loaded into memory 706. Processor unit 704 includes one or more processors. For example, processor unit 704 can be selected from at least one of a multicore processor, a central processing unit (CPU), a graphics processing unit (GPU), a physics processing unit (PPU), a digital signal processor (DSP), a network processor, or some other suitable type of processor. For example, further, processor unit 704 can may be implemented using one or more heterogeneous processor systems in which a main processor is present with secondary processors on a single chip. As another illustrative example, processor unit 704 can be a symmetric multi-processor system containing multiple processors of the same type on a single chip.

Memory 706 and persistent storage 708 are examples of storage devices 716. A storage device is any piece of hardware that is capable of storing information, such as, for example, without limitation, at least one of data, program code in functional form, or other suitable information either on a temporary basis, a permanent basis, or both on a temporary basis and a permanent basis. Storage devices 716 may also be referred to as computer-readable storage devices in these illustrative examples. Memory 706, in these examples, can be, for example, a random-access memory or any other suitable volatile or non-volatile storage device. Persistent storage 708 may take various forms, depending on the particular implementation.

For example, persistent storage 708 may contain one or more components or devices. For example, persistent storage 708 can be a hard drive, a solid-state drive (SSD), a flash memory, a rewritable optical disk, a rewritable magnetic tape, or some combination of the above. The media used by persistent storage 708 also can be removable. For example, a removable hard drive can be used for persistent storage 708.

Communications unit 710, in these illustrative examples, provides for communications with other data processing systems or devices. In these illustrative examples, communications unit 710 is a network interface card.

Input/output unit 712 allows for input and output of data with other devices that can be connected to data processing system 700. For example, input/output unit 712 may provide a connection for user input through at least one of a keyboard, a mouse, or some other suitable input device. Further, input/output unit 712 may send output to a printer. Display 714 provides a mechanism to display information to a user.

Instructions for at least one of the operating system, applications, or programs can be located in storage devices 716, which are in communication with processor unit 704 through communications framework 702. The processes of the different embodiments can be performed by processor unit 704 using computer-implemented instructions, which may be located in a memory, such as memory 706.

These instructions are referred to as program code, computer usable program code, or computer-readable program code that can be read and executed by a processor in processor unit 704. The program code in the different embodiments can be embodied on different physical or computer-readable storage media, such as memory 706 or persistent storage 708.

Program code 718 is located in a functional form on computer-readable media 720 that is selectively removable and can be loaded onto or transferred to data processing system 700 for execution by processor unit 704. Program code 718 and computer-readable media 720 form computer program product 722 in these illustrative examples. In the illustrative example, computer-readable media 720 is computer-readable storage media 724.

In these illustrative examples, computer-readable storage media 724 is a physical or tangible storage device used to store program code 718 rather than a medium that propagates or transmits program code 718.

Alternatively, program code 718 can be transferred to data processing system 700 using a computer-readable signal media. The computer-readable signal media can be, for example, a propagated data signal containing program code 718. For example, the computer-readable signal media can be at least one of an electromagnetic signal, an optical signal, or any other suitable type of signal. These signals can be transmitted over connections, such as wireless connections, optical fiber cable, coaxial cable, a wire, or any other suitable type of connection.

The different components illustrated for data processing system 700 are not meant to provide architectural limitations to the manner in which different embodiments can be implemented. In some illustrative examples, one or more of the components may be incorporated in, or otherwise form a portion of, another component. For example, memory 706, or portions thereof, may be incorporated in processor unit 704 in some illustrative examples. The different illustrative embodiments can be implemented in a data processing system including components in addition to or in place of those illustrated for data processing system 700. Other components shown in FIG. 7 can be varied from the illustrative examples shown. The different embodiments can be implemented using any hardware device or system capable of running program code 718.

Thus, illustrative embodiments of the present invention provide a computer implemented method, an apparatus, a computer system, and a computer program product for processing vehicle accident information. Selected information is collected from a sensor system for vehicle to form initial accident information in response to detecting an accident involving the vehicle. A first assessment of a severity of the accident is determined using the initial accident information. A vehicle notification of the accident is sent by the computer system onto a distributed network. A set of client devices located within a selected distance from the vehicle is searched for in response to the vehicle notification of the accident. Additional accident information is requested from the set of client devices when the set of client devices are present within the selected distance from the vehicle. A second assessment of the severity of the accident is determined using the initial accident information and the additional accident information received from the set of client devices.

The illustrative examples provide one or more technical solutions that overcome a technical problem with managing accident information in response to the occurrence of an accident involving a vehicle. As a result, the illustrative examples provide a more efficient and complete processing of accident information for vehicle accidents. In one illustrative example, initial accident information is collected and stored using a data processing system in a vehicle such as an onboard unit in response to detecting the occurrence of an accident using a sensor system for the vehicle. This collection is performed as soon as possible to avoid a loss of data. Further, the illustrative examples can ensure the integrity of the data using alteration protection data. For example, a hash function can be applied to the initial accident information to generate hash values. The hash values can be used to determine whether changes occurred to the initial accident information collected by the vehicle.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiment. The terminology used herein was chosen to best explain the principles of the embodiment, the practical application or technical improvement over technologies found in the marketplace, or to enable others of ordinary skill in the art to understand the embodiments disclosed here.

What is claimed is:

1. A method for processing accident information for a vehicle, the method comprising:

collecting, by a computer system, initial accident information from a sensor system installed on the vehicle in response to detecting an accident involving the vehicle;

determining, by the computer system, a first assessment of a severity of the accident using the initial accident information;

sending, by the computer system, a vehicle notification of the accident onto a distributed network;

searching, by the computer system, for a set of client devices located within a selected distance from the accident in response the vehicle notification of the accident, wherein each client device of the set of client devices is communicatively coupled with the computer system through the distributed network;

requesting, by the computer system, additional accident information from the set of client devices when the set of client devices are present within the selected distance from the accident;

determining, by the computer system, a second assessment of the severity of the accident using the initial accident information and the additional accident information received from the set of client devices; and sending, by the computer system, an interested party notification including the second assessment to a set of interested parties based on the second assessment of the severity of the accident, wherein different interested parties within the set of interested parties are notified if the second assessment changes from the first assessment.

2. The method of claim 1, wherein sending, by the computer system, the vehicle notification of the accident onto the distributed network using the initial accident information comprises:

sending, by the computer system, the vehicle notification of the accident onto the distributed network, wherein the vehicle notification includes a portion of the initial accident information.

3. The method of claim 2 further comprising:

determining, by the computer system, the portion of the initial accident information to send in the vehicle notification based on a bandwidth available to send the vehicle notification from the vehicle to the distributed network.

4. The method of claim 1 further comprising:

generating, by the computer system, alteration protection data from the initial accident information, wherein vehicle notification includes the alteration protection data and the alteration protection data is used to determine whether the initial accident information has been changed.

5. The method of claim 4, wherein the alteration protection data is selected from at least one of a hash value, a checksum, or a check digit.

6. The method of claim 1, wherein the distributed network is a blockchain network in which data processing systems within the blockchain network store the initial accident information received from the vehicle and the additional accident information received from the set of client devices in blocks in a blockchain in the blockchain network.

7. The method of claim 1, wherein collecting, by the computer system, the initial accident information from the sensor system in response to detecting the accident involving the vehicle; determining, by the computer system, the first assessment of the severity of the accident using the initial accident information; and sending, by the computer system, the vehicle notification of the accident onto the distributed network are performed by an onboard unit in the computer system located in the vehicle.

8. The method of claim 1, wherein searching, by the computer system, for the set of client devices located within the selected distance from the accident in response to the vehicle notification of the accident; requesting, by the computer system, the additional accident information from the set of client devices when the set of client devices are present within the selected distance from the accident; and determining, by the computer system, the second assessment of the severity of the accident using the initial accident information and the additional accident information received from the set of client devices are performed the distributed network in the computer system.

9. The method of claim 1, wherein the initial accident information comprises at least one of global positioning system data, accelerometer data, air bag state, a video recording, audio recording, heart rate of an occupant, blood pressure of the occupant, or temperature of the occupant and wherein the additional accident information comprises at least one of traffic information, an accident report, an additional video recording, an additional audio recording, an image, or a witness report.

10. A vehicle accident information system comprising:

a computer system configured to collect initial accident information from a sensor system installed on a vehicle in response to detecting an accident involving the vehicle; determine a first assessment of a severity of the accident using the initial accident information; send a vehicle notification of the accident onto a distributed network; search for a set of client devices located within a selected distance from the accident in response to the vehicle notification of the accident; request additional accident information from the set of client devices when the set of client devices are present within the selected distance from the accident; determine a second assessment of the severity of the accident using the initial accident information and the additional accident information received from the set of client devices, wherein each client device of the set of client devices is communicatively coupled with the computer system through the distributed network; and send an interested party notification including the second assessment to a set of interested parties based on the second assessment of the severity of the accident, wherein different interested parties within the set of interested parties are notified if the second assessment changes from the first assessment.

11. The vehicle accident information system of claim 10, wherein in sending the vehicle notification of the accident onto the distributed network using the initial accident information, the computer system sends the vehicle notification of the accident onto the distributed network, wherein the vehicle notification includes a portion of the initial accident information.

12. The vehicle accident information system of claim 11, wherein the computer system determines the portion of the initial accident information to send in the vehicle notification based on a bandwidth available to send the vehicle notification from the vehicle to the distributed network.

13. The vehicle accident information system of claim 10, wherein the computer system generates alteration protection data from the initial accident information, wherein the vehicle notification includes the alteration protection data and the alteration protection data is used to determine whether the initial accident information has been changed.

14. A computer program product for processing vehicle accident information, the computer program product comprising:

a computer-readable storage media;

program code, stored on the computer-readable storage media, for collecting initial accident information from a sensor system installed on a vehicle in response to detecting an accident involving the vehicle;

program code for determining a first assessment of a severity of the accident using the initial accident information;

program code, stored on the computer-readable storage media, for sending a vehicle notification of the accident onto a distributed network;

program code, stored on the computer-readable storage media, for searching for a set of client devices located within a selected distance from the accident in response to the vehicle notification of the accident, wherein each client device of the set of client devices is communicatively coupled with each other client device of the set of client devices through the distributed network;

program code, stored on the computer-readable storage media, for requesting additional accident information from the set of client devices when the set of client devices are present within the selected distance from the accident;

program code, stored on the computer-readable storage media, for determining a second assessment of the severity of the accident using the initial accident information and the additional accident information received from the set of client devices; and program code, stored on the computer-readable storage media, for sending an interested party notification including the second assessment to a set of interested parties based on the second assessment of the severity of the accident, wherein different interested parties within the set of interested parties are notified if the second assessment changes from the first assessment.

15. The computer program product of claim 14, wherein the program code for sending a vehicle notification of the accident onto a distributed network comprises:

program code, stored on the computer-readable storage media, for sending the vehicle notification of the accident onto the distributed network, wherein the vehicle notification includes a portion of the initial accident information.

16. The computer program product of claim 15 further comprising:

program code, stored on the computer-readable storage media, for determining the portion of the initial accident information to send in the vehicle notification based on a bandwidth available to send the vehicle notification from the vehicle to the distributed network.

17. The computer program product of claim 14 further comprising:

program code, stored on the computer-readable storage media, for generating alteration protection data from the initial accident information, wherein the vehicle notification includes the alteration protection data and wherein alteration protection data is used to determine whether the initial accident information has been changed.

* * * * *